US009280943B2

(12) United States Patent
Kimpe et al.

(10) Patent No.: US 9,280,943 B2
(45) Date of Patent: Mar. 8, 2016

(54) DEVICES AND METHODS FOR REDUCING ARTEFACTS IN DISPLAY DEVICES BY THE USE OF OVERDRIVE

(75) Inventors: Tom Kimpe, Ghent (BE); Cédric Marchessoux, Halluin (FR)

(73) Assignee: BARCO, N.V., Kortrijk (BE)

( * ) Notice: Subject to any disclaimer, the term of this patent is extended or adjusted under 35 U.S.C. 154(b) by 843 days.

(21) Appl. No.: 12/371,028

(22) Filed: Feb. 13, 2009

(65) Prior Publication Data

US 2010/0207960 A1 Aug. 19, 2010

(51) Int. Cl.

| | |
|---|---|
| ***G09G 3/00*** | (2006.01) |
| ***G09G 3/36*** | (2006.01) |
| *G09G 3/20* | (2006.01) |

(52) U.S. Cl.

CPC ..... *G09G 3/3648* (2013.01); *G09G 3/2044* (2013.01); *G09G 2320/0247* (2013.01); *G09G 2320/0252* (2013.01); *G09G 2320/041* (2013.01); *G09G 2320/0666* (2013.01); *G09G 2340/16* (2013.01); *G09G 2360/18* (2013.01)

(58) Field of Classification Search

CPC ..... G09G 3/006; G09G 3/04; G06F 11/162
USPC ..... 345/87–100, 204, 207–208, 210–214, 345/698–699, 690

See application file for complete search history.

(56) References Cited

U.S. PATENT DOCUMENTS

| | | | | |
|---|---|---|---|---|
| 5,119,084 | A | 6/1992 | Kawamura et al. | |
| 7,696,988 | B2 * | 4/2010 | Wu et al. | 345/204 |
| 7,986,314 | B2 * | 7/2011 | Tsai et al. | 345/204 |
| 8,154,491 | B2 * | 4/2012 | Ho et al. | 345/87 |
| 8,384,826 | B2 * | 2/2013 | Mori et al. | 348/441 |
| 2003/0006949 | A1 | 1/2003 | Sekiya et al. | |
| 2003/0235327 | A1 * | 12/2003 | Srinivasa | 382/104 |
| 2004/0090407 | A1 | 5/2004 | Park et al. | |
| 2005/0162360 | A1 * | 7/2005 | Ishihara et al. | 345/89 |
| 2006/0125812 | A1 * | 6/2006 | Lee | 345/204 |
| 2006/0262147 | A1 * | 11/2006 | Kimpe et al. | 345/690 |

(Continued)

FOREIGN PATENT DOCUMENTS

| | | |
|---|---|---|
| CN | 1499475 A | 5/2004 |
| CN | 1815543 A | 8/2006 |

(Continued)

OTHER PUBLICATIONS

EPO Communication in related application No. 10 713 799.4 dated Nov. 8, 2012.

(Continued)

*Primary Examiner* — Kumar Patel
*Assistant Examiner* — Mansour M Said
(74) *Attorney, Agent, or Firm* — Bacon & Thomas, PLLC

(57) ABSTRACT

The invention relates to a method for reducing imaging artifacts during a frame-changeover from a current frame to a following frame displayed by a display device comprising a plurality of pixels, wherein the artifacts are reduced by overdriving at least one control signal for controlling the pixel intensity of the related pixel during the frame-changeover, wherein the overdrive is carried out in dependence of the magnitude of an intensity step between a designated start intensity value of the pixel within the current frame and a designated target intensity value of the pixel within the following frame.

19 Claims, 8 Drawing Sheets

(56) References Cited

U.S. PATENT DOCUMENTS

| | | | | |
|---|---|---|---|---|
| 2007/0126657 | A1* | 6/2007 | Kimpe | 345/55 |
| 2009/0015576 | A1* | 1/2009 | Hu | 345/211 |
| 2009/0213050 | A1* | 8/2009 | Hung | 345/87 |

FOREIGN PATENT DOCUMENTS

| | | | |
|---|---|---|---|
| CN | 101334984 | A | 12/2008 |
| EP | 1 391 867 | A1 | 8/2003 |
| EP | 1443487 | A1 | 8/2004 |
| EP | 1 669 976 | A2 | 6/2006 |
| JP | 2004-117527 | A | 4/2004 |
| JP | 2005-141190 | A | 6/2005 |

OTHER PUBLICATIONS

Japanese Office Action for corresponding Application No. 2011-5495566, dated Mar. 5, 2013, English translation thereof.

Chinese Office Action for CN 201080008026.0, dated May 2, 2013, and English translation thereof.

Written Opinion issued in PCT/EP2010/051745, mailed Feb. 1, 2011.

International Search Report issued in PCT/EP2010/051745, mailed Feb. 1, 2011.

European Office Action dated Jun. 17, 2014, issued in EP 10 713 799.4.

European Summons to Attend Oral Proceedings pursuant to Rule 115(1) EPC dated Apr. 7, 2015, for EP 10713799.4.

Chinese Office Action dated Jan. 15, 2014, issued in related CN 201080008026.0, and English translation thereof.

Japanese Office Action dated Mar. 4, 2014, issued in related JP 2011-549566, and English translation thereof.

European Decision to Refuse dated Dec. 21, 2015, for EP 10713799.4.

* cited by examiner

DEVICES AND METHODS FOR REDUCING ARTEFACTS IN DISPLAY DEVICES BY THE USE OF OVERDRIVE

The invention relates to display devices, controllers for controlling the operation of display devices, software and methods of driving display devices. In particular, the present invention relates to a display device, a controller for controlling the operation of a display device, software and a method for reducing imaging artefacts during a frame-changeover from a current frame to a following frame displayed by a display device comprising a plurality of pixels by overdriving at least one control signal during the frame-changeover.

TECHNICAL BACKGROUND

In modern medical facilities, high-quality medical imaging using display devices like liquid crystal display devices (LCD devices) is more important than ever before. Each pixel of a liquid crystal display panel (LCD panel) of the LCD device is assumed to a discrete intensity value (luminance value) of a set of values, e.g. a set of values with a bit depth of 10 bits [0 . . . 1023], wherein a pixel group of three of these pixels, a red (R), green (G) and blue (B) pixel, is updated each frame period. The liquid crystal display suffers from slow response time of the pixels. It can take several frame periods before a pixel actually reaches a requested intensity target value of the set. In case of static images this is not a problem because eventually the pixel of the liquid crystal display panel reaches its target and then the image is stable for a long time. But more and more in medical imaging also moving images are used for diagnosis. A few examples are stack reading of computed tomography (CT) or, MRI images (MRI: Magnetic resonance imaging) or use of ultrasound.

Full body computed tomography scans can have up to 3000 slices. It is clear that radiologists want to browse rapidly through such large image sets and only inspect specific slices in detail, e.g. if something suspicious is detected while browsing. And in the near future tomosynthesis will be approved. In tomosynthesis, mammographers will be looking for subtle, small image features in a set of ±50 slices. Browsing speeds will be between 5-10 slices per second because they want to do an initial scan of the entire set in about one to two seconds.

Studies have shown that reading at a speed of ten slices per second on a typical medical display like a standard 5 megapixel (5 MP) mammography display device can result in a decrease of clinical accuracy of up to 10%. The magnitude of this decrease is not acceptable. The reason for this decrease is that the slow response of the pixels, e.g. LCD pixels, introduces "motion blur" when showing moving images.

The slow response time of LCD pixels is a well known problem. Also, overdrive during a frame-changeover from a current frame to a following frame has been suggested as a solution. If the intensity of a display pixel is driven in a normal way it can take several chronological following frames before the pixel reaches the targeted intensity of one of said following frames. Overdrive refers to applying an overdrive signal temporarily such that the pixel will reach its designated following intensity level faster, ideally in a single frame-changeover.

Medical images have their own characteristics. Typically, medical images are rather noisy which means that the change within two consecutive images can be simply caused by image noise e.g. caused by the detector system. Therefore, even if there is no pathologic structure present (e.g. a cancer) there will be a continuous change in pixel intensity values when browsing through a stack of frames. Standard liquid crystal display devices, as a side effect of their slow response time, unintentionally apply noise reduction. Indeed, because of their slow response time, the small changes in pixel intensity values (image noise) during the frame-changeover are not visualized very well because the pixel intensity never reaches the target intensity level of the following frame. As a result, this image noise is suppressed when browsing through a stack of images.

Simulations and some visual tests have shown that, when display devices with faster response time than a standard liquid crystal display device are used, the inherent image noise is enhanced and much more visible. As a result, radiologists subjectively assign lower image quality to a display with improved response time.

Medical display systems very often use temporal dithering to increase the perceived intensity bit depth of the display device. This means that the panel of the display device will be driven with slightly different intensity values every frame such that the eye will perceive an average value which lies in between two native levels of the panel. Due to the slow response time of LCDs (and in particular slow grey to grey response), the actual measured luminance value or intensity value of a pixel, when driven with temporal dithering, will be rather stable (the pixel intensity never reaches the two different levels but stays in a condition somewhere in between).

When standard overdrive is being applied however, then the drive signals are altered such that the pixel intensity reaches as much as possible the individual levels used in the temporal dither scheme. This will result in a higher level of "flicker" of the display device. Although this flicker may be hard to see visually, it can be easily measured and even these measurement results can cause reluctance in the medical market.

SUMMARY OF THE INVENTION

It is the object of the invention to provide display devices, controllers for controlling the operation of display devices, software and methods of driving them.

An advantage of the present invention is the provision of a device, controllers for controlling the operation of display devices, software and method for reducing imaging artefacts during a frame-changeover from a current frame to a following frame. A device, controllers for controlling the operation of display devices, software and method for reducing imaging artefacts in accordance with embodiments of the present invention take into account typical noise characteristics of the pictured images so as to reduce artefacts in the displayed images.

To achieve this object, the present invention provides a device, of a device, a controller for controlling the operation of display devices, software and a method for reducing imaging artefacts during a frame-changeover from a current frame to a following frame displayed by a liquid crystal display device comprising a plurality of pixels by overdriving at least one control signal during the frame-changeover.

In embodiments of the invention the artefacts are reduced by overdriving at least one control signal for controlling the pixel intensity of the pixel under consideration during the frame-changeover, wherein the overdrive is carried out in dependence of the magnitude of an intensity step between the designated start intensity value of the pixel within the current frame and a designated target intensity value of the pixel within the following frame. The intensity values are discrete intensity levels (luminance values) of a set of values. The current frame and the following frame after the frame-changeover within one frame period is displayed by the display device.

An aspect of the present invention is the application of overdrive if (and only it) a given condition on the intensity step is met.

The magnitude of the overdrive can depend on an intensity step between a designated start intensity value of the pixel within the current frame and a designated target intensity value of the pixel within a or the following frame This can mean a binary decision (carrying out overdrive or not) as well as a weighting of the amount of overdrive that will be carried out.

The magnitude of overdrive is e.g. relative to the optimal amount of overdrive. Optimal can mean the overdrive level that results in the fastest transition without risking over-shoot of the pixel.

The magnitude of an intensity step between the designated start intensity value of the pixel within the current frame and the designated target intensity value of the pixel within the following frame is completely independent from a currently reached intensity level (or current state) of the pixel within the current frame. No information on the reached intensity level or current state of the pixel is needed to determine the magnitude of the overdrive and to perform the method according to the invention.

In medical imaging there is an increasing use of moving images for diagnosis. A few examples are stack reading of computed tomography (CT) or, MRI images (MRI: Magnetic resonance imaging) or use of ultrasound. Medical images have their own characteristics. Typically these medical images are rather noisy which means that the change within two consecutive images can simply caused by image noise e.g. caused by the detector system. Therefore, even if there is no interest point, e.g. pathologic structure present in the image, there will be a continuous change in pixel intensity values when browsing through a stack of frames.

Medical display systems very often use temporal dithering to increase the perceived intensity bit depth of the display device. This means that the display device will be driven with slightly different intensity values every frame such that the eye will perceive an average value which lies in between two native levels of the panel.

According to a preferred embodiment of the invention, the method comprises the further step of determining an image noise characteristic from a set of frames, the set comprising at least the current frame and another frame, e.g. a or the following frame, wherein the overdrive is based upon the determined image noise characteristic.

According to another preferred embodiment of the invention, the magnitude of the overdrive is based on a set of predetermined overdrive magnitudes. Especially, the pre-determined overdrive magnitudes are stored in an overdrive converter that can be a table or any other suitable device that provides an overdrive value as an output.

According to a preferred embodiment of the invention, the overdrive is carried out additionally in dependence of the magnitude of an intensity step between a currently reached intensity level of the pixel within the current frame and the target intensity value of the pixel within the following frame.

According to yet another preferred embodiment of the invention, the magnitude of the overdrive is adjusted by a predetermined overdrive weighting factor or predetermined overdrive weighting function, e.g. optionally talking the human visual perception system into account. In embodiments of the present invention the overdrive weighting factor can be the ROV (Relative Overdrive value). Especially, the predetermined overdrive weighting factor or overdrive weighting function is stored in an overdrive weighting converter that can be in the form of a table. These weighting factors can be based on the human visual perception system, and can be chosen in such a way that the same perceptual amount of overdrive will be perceived by a human observer independent of the exact pixel transition that has taken place ("achieving a uniform level of overdrive"), and this for all possible pixel transitions or a chosen of possible pixel transitions.

According to a preferred embodiment of the invention, the display device is a liquid crystal display device. Liquid crystal display devices (LCD devices) are commonly used display devices of medical display systems. Medical imaging is used in computed tomography systems, magnetic resonance imaging systems or ultrasound systems, for example. Each pixel of a liquid crystal display panel (LCD panel) of the LCD device is assumed to acquire a discrete intensity value (luminance value) selected from a set of values, e.g. a set of values with a typical bit depth of 12 to 16 bits.

In still another embodiment of the invention, the artefacts are reduced by overdriving each individual control signal for controlling the intensity of each related pixel during the frame-changeover. Because no information on the reached intensity or current state of the pixel is needed to determine the magnitude of the overdrive, individual control signals can be generated very quickly.

These and other aspects of the invention will be apparent from and elucidated with reference to the embodiments described hereinafter as well as the appended drawings and claims.

DETAILED DESCRIPTION OF THE ILLUSTRATIVE EMBODIMENT

Figure 1:
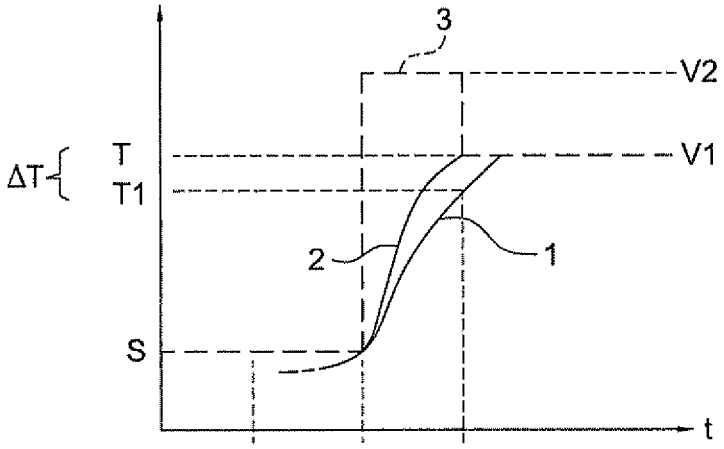
FIG. 1 shows a comparison between an un-overdriven pixel intensity curve and an overdriven pixel intensity curve in accordance with an embodiment of the invention during a frame-changeover.
Figure 3A:
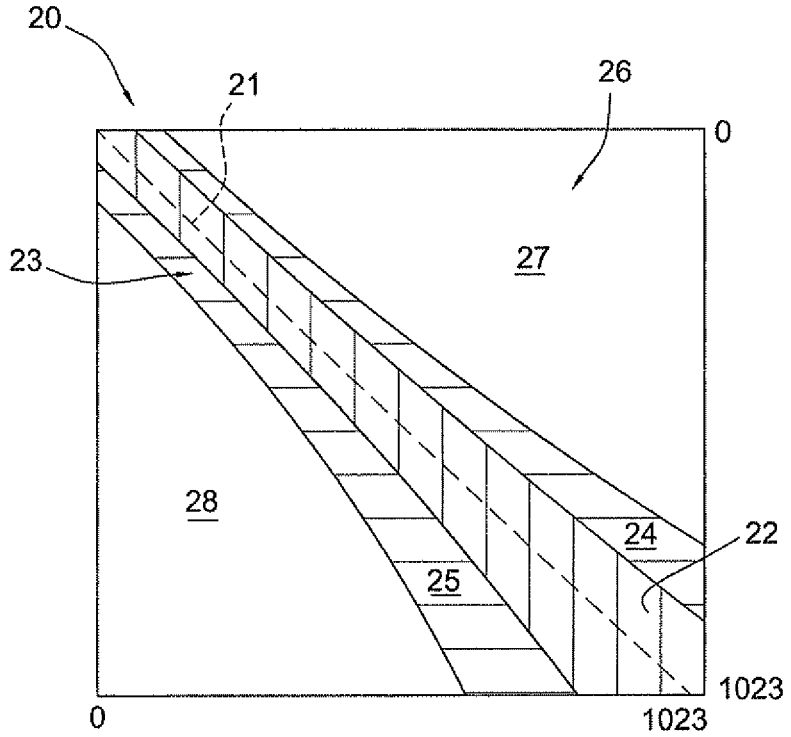
FIG. 3 shows an overdrive weighting table, wherein each cell of the table comprises a predetermined overdrive weighting factor, talking the human visual perception system into account in accordance with an embodiment of the invention (details in FIGS. 3*a-e*)

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B.

FIG. 1 shows a comparison between an un-overdriven pixel intensity curve 1 and an overdriven pixel intensity curve 2 in accordance with an embodiment of the invention during a frame-changeover. In the example shown in FIG. 1, the pixel has a designated start intensity value S of a current frame and a designated target intensity value T of a or the following frame. When the control signal 3 for controlling the pixel intensity is not overdriven (un-overdriven), i.e. a control signal 3 (e.g. a voltage V1) is applied consistent with the target intensity value, the pixel value achieved T1 falls short of the target intensity value T by a value ΔT resulting in an artefact in subsequent frames. However, if a higher control signal 3 (voltage V2>V1) consistent with an overdrive intensity value, the target intensity value T is reached within the frame period thereby eliminating artefact in subsequent frames (in case of rising: CL<=T and CL>=T in case of falling).

According to an embodiment of the invention provides a display device, a method of driving the display device and a controller for controlling a display device in which the artefacts are reduced by overdriving at least one control signal 3 for controlling the pixel intensity of the related pixel during the frame-changeover, wherein the overdrive is carried out in dependence of the magnitude of an intensity step between the designated start intensity value S of the pixel within the current frame and the designated target intensity value T of the pixel within the or a following frame. In one aspect of the present invention an accurate characterisation of the display devices optical response on the control signal is required.

Figure 2A:
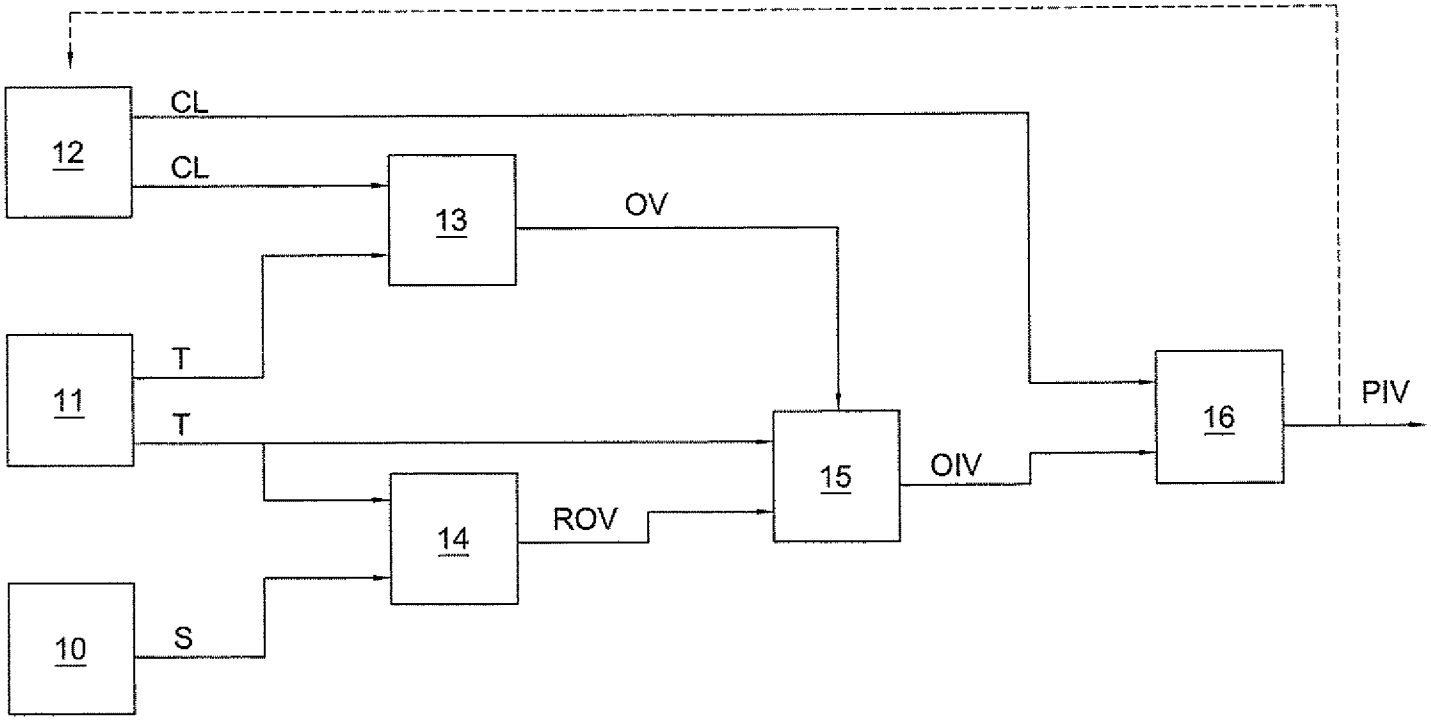
FIG. 2*a* shows a block scheme of determining an overdrive magnitude and a pixel intensity value during a frame-changeover in accordance with an embodiment of the invention.

FIG. 2*a* shows a block scheme of a method for determining the overdrive magnitude during the frame-changeover for one individual pixel in accordance with a preferred embodiment of the invention. Starting points are pre-determined values S, T, CL stored in three frame memories 10, 11, 12. The first frame memory 10 stores a set of start intensity values S of the pixels within the current frame; the second frame memory 11 stores the target intensity values T of the pixels within a or the following frame that follows the current frame, and the third memory 12 stores the currently reached intensity levels CL of the pixels within the current frame.

In a first step an overdrive value OV of the control signal is determined from the currently reached intensity level CL from the third memory 12 and the target intensity value T from the second memory 11. The first step gives as an output the overdrive value OV that needs to be added to the data sent to the corresponding pixels of the display device.

Performing the first step may be done in particular with any suitable intensity value CL to overdrive value converter such as a first Look up Table (LUT) 13 that associates an overdrive value OV with each set of values (CL, T). Hence, in a first step a first Look Up Table (LUT) 13 indicates an overdrive value OV of the control signal from/based on the currently reached intensity level CL from the third memory 12 and the target intensity value T from the second memory 11. The first LUT 13 gives as an output the overdrive value OV that needs to be added to the data sent to the corresponding pixels of the display device.

The determination of OV may also be done by other intensity value CL to overdrive value converter means such as with a software defined analytical function. Another means to determine OV is the interpolation (linear, polynomial . . . ) of OV based on a limited number of known sets of values (Cl, T, OV). See for instance David Kidner, Mark Dorey and Derek Smith (1999) "What's the point? Interpolation and extrapolation with a regular grid DEM" IV International Conference on GeoComputation, Fredericksburg, Va., USA; Kincaid, David and Ward Cheney (2002) "Numerical Analysis (3rd edition)" Brooks/Cole ISBN 0-534-38905-8 Chapter 6; Schatzman, Michelle (2002) "Numerical Analysis: A Mathematical Introduction" Clarendon Press, Oxford. ISBN 0-19-850279-6 Chapters 4 and 6.

Yet other mathematical means of evaluating OV in function of CL and T includes but are not limited to neural networks (see e.g. IEEE TRANSACTIONS ON NEURAL NETWORKS, VOL. 16, NO. 1, January 2005 "Smooth Function Approximation Using Neural Networks" Silvia Ferrari and Robert F. Stengel) and fuzzy logic (R. Rojas: Neural Networks, Springer-Verlag, Berlin, 1996 chapter 11 paragraph 11.3.3 "Function approximation with fuzzy methods").

The first LUT 13 can be filled up based on simulation or calculation, for example. For instance, for an average pixel representative of all the pixels of the display, e.g. LCD/LCOS to be driven, an overdrive value is chosen or determined or simulated that will give the desired target intensity level T within a frame period when the currently reached intensity level, that is the intensity level that would be reached without overdrive, within the frame period is CL. The overdrive value OV determined for every set (CL,T) is stored in first look up table.

As will be realized by those skilled in the art, the output generated by the mathematical means considered here above may or may not have to be formatted (e.g. a truncation or a rounding may be necessary) before being used in the third step below for the determination of an overdrive intensity value.

In a second step a relative overdrive value ROV of the control signal is determined from the start intensity value S from the first memory 10 and the target intensity value T from the second memory 11. The second step 14 gives as an output the relative overdrive value ROV for the current frame-changeover.

The second step can be carried out using a start intensity/target intensity relative drive value ROV converter such as a second Look Up Table 14 or any other converter device as described above with reference to the first step and LUT 13.

In a third step an overdrive intensity value OIV of the control signal is determined from the target intensity value TV, the overdrive value OV and the relative overdrive value ROV, e.g. in output calculation module 15. Accordingly the overdrive intensity value OIV is given as equation 1, $$OIV=TV+ROV\cdot OV \quad (1)$$

In a fourth step a pixel intensity value PV of the control signal 3 is determined from the currently reached intensity level CL from the third memory 12 and the target intensity value T from the second memory 11, e.g. in predict LUT 16. The fourth step gives as an output from LUT 16 the intensity value IV that will actually be reached after one frame-changeover. The intensity value IV may be the target intensity value T, but is not necessarily this value.

Figure 6:
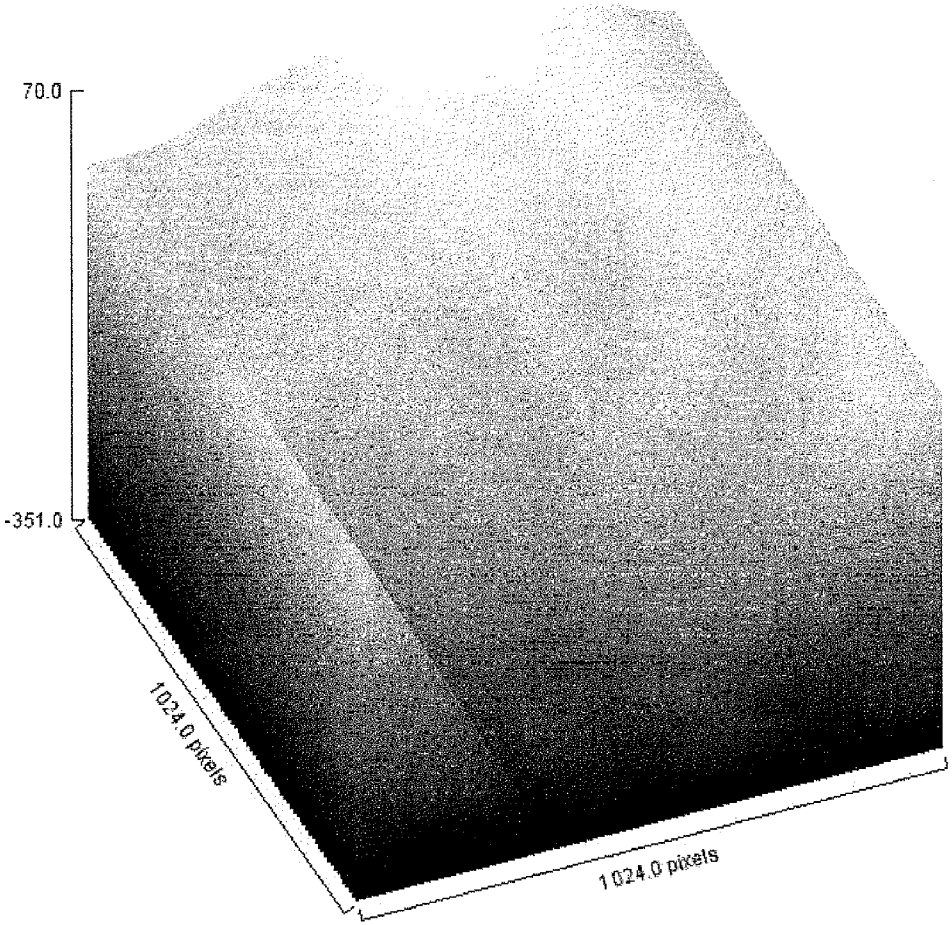
FIG. 6 shows a 2D Look up Table in accordance with an embodiment of the present invention being a multiplication of two Look up Tables used in steps 13 and 14 respectively.

As alternative, the intensity value CL to overdrive value converter and the start intensity/target intensity relative drive value ROV converter, e.g. in each case the first and second LUTs 13, 14 can be combined in one converter such as one third LUT thanks to a simple multiplication to obtain a further converter 17 such as the third 2D LUT (shown schematically in FIG. 6 and exemplified in FIG. 2*b*), therefore the output is directly ROV.OV. Moreover, to reduce the size in memory for implementation issues, bidimensional interpolation can be applied (either bilinear or bicubic).

Figure 2B:
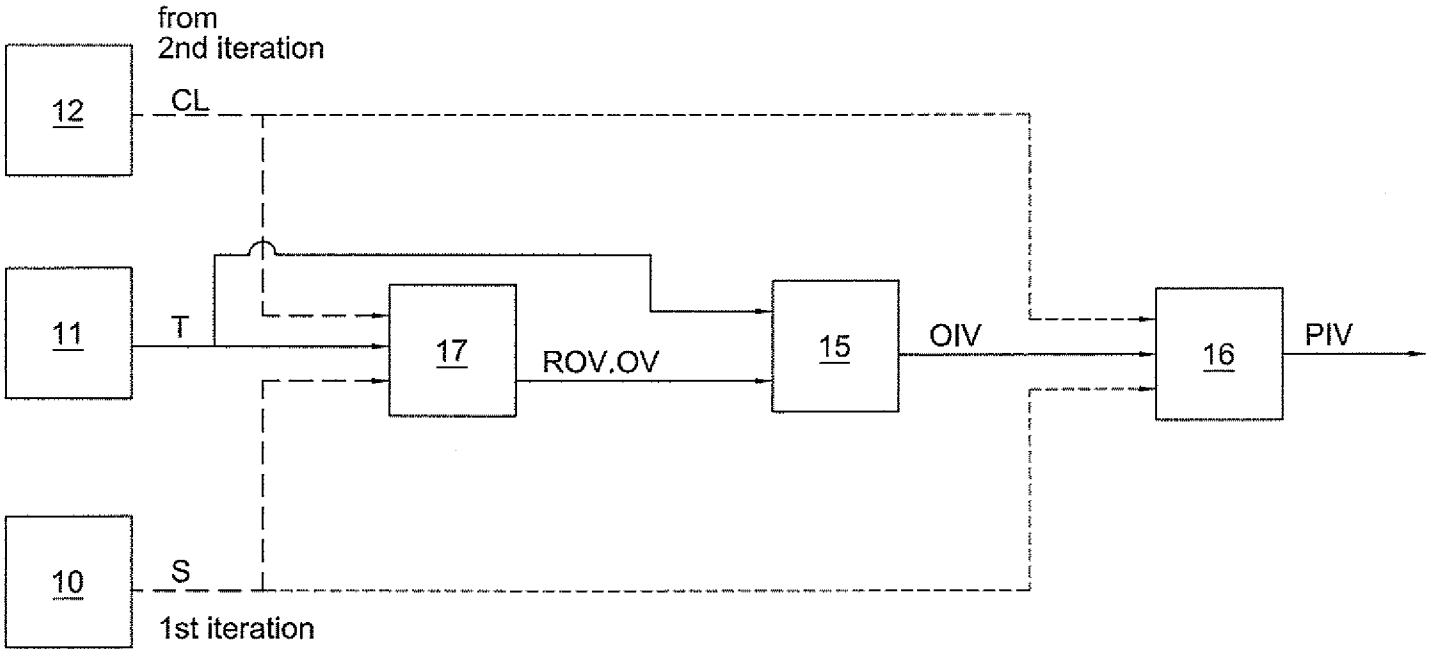
FIG. 2*b* shows a further block scheme of determining an overdrive magnitude and a pixel intensity value during a frame-changeover in accordance with an embodiment of the invention.

In FIG. 2*b* an alternative hardware implementation with 2 LUTs instead of 3 LUT's is shown (e.g. as shown in FIG. 2*a*). This embodiment includes the 2D LUT 17. The 2D overdriving LUT 17 calculates the overdriving value ROV.OV because the 2D LUT 17 has values of the first LUT 13 multiplied by values of the second LUT 14 from FIG. 2*a*.

An output calculation module 15 adds the overdriving value to the input video and does over- and underflow checks and limiter.

The 2D predict LUT 16 calculates what is the current value after one frame from equation 1:

$$OIV=T+ROV\cdot OV \quad (1)$$

The LUTs 17 and 16 are, for example, in pre-processing up-sampled from 7×7 bits to 10×10 bits (128×128 to 1024×1024). Either bilinear bicubic interpolation is used.

In the pipeline of processing, the reducing artefact solution is placed after the image processing.

An optical measurement system can be used to record the different pixel intensity transitions. A physical model can be used to fit the raw point measurements. The pixel intensity value is converted to the intensity emitted by the display in $cd/m^2$ due to the non-linearity behavior of LCD panel, e.g. s-curve native, Intensity-Luminance value in function of digital driving level.

The proposed method (or algorithm) determines a degree of overdrive that needs to be determined based on the requested intensity step. Accordingly, the degree of overdrive is not determined based on the actual state of the pixel. Small intensity steps (i.e. pixel transitions) that are likely to be noise will not be (or will be relatively little) overdriven. Larger intensity steps (i.e. pixel transitions) that are likely to contain a useful signal will be fully overdriven. To determine what small and large transitions are, a characterization of the image noise is preferably performed. In accordance with separate embodiments of the present invention, this characterization can either be done online or offline. If it is done online then a step can be to determine e.g. to calculate a noise floor of the images being displayed and use this information to decide what control signals will be overdriven. Calculating the noise floor of the images being displayed can be done continuously or at regular intervals. In an alternative embodiment this can be done offline, e.g. by selecting degrees of overdriving based on the type of image or the type of detector being used. One can then use these "presets" based on the image type or detector type being visualized at a specific moment in time. In accordance with a further embodiment of the present invention a software application product is provided that generates this information or a software product is provided that executes a content analysis algorithm on a processing engine that detect this information automatically.

The above methods solve the problem of temporal dithering. Temporal dithering algorithms will always request very small grey level transitions (typically a single step). The proposed overdrive algorithm will treat this as noise and will not apply overdrive on these signals. This will result in fewer flickers. It is a specific aspect of the present invention that the display device, method of driving the display device and controller for controlling a display device according to the present invention, in which the artefacts are reduced by overdriving at least one control signal 3 for controlling the pixel intensity of the related pixel during the frame-changeover, ignore small grey level transitions resulting from temporal dithering.

It also solves the problem of enhanced visibility of image noise while browsing through medical image stacks. Indeed, the proposed algorithm will not enhance transitions that are likely to be image noise, and therefore images will not look noisier. It is another specific aspect of the present invention that the display device, method of driving the display device and controller for controlling a display device according to the present invention, in which the artefacts are reduced by overdriving at least one control signal 3 for controlling the pixel intensity of the related pixel during the frame-changeover, does not enhance transitions that are likely to be image noise.

FIG. 3 (FIGS. 3*a*-*e*) shows an overdrive weighting converter e.g. table 20, wherein the table cells (not shown) of each line represent the discrete set of designated current intensity level values [0 . . . 1023] of the pixel within the current frame and the table cells of each row represent the discrete set of designated following intensity level values [0 . . . 1023] of the pixel within the current frame. Each cell comprises a predetermined overdrive weighting factor W or predetermined overdrive weighting function, taking the human visual perception system (the average human eye) into account. In embodiments of the present invention the value W is the same as the value ROV in equation 1.

The overdrive weighting table shows a mirror-symmetrical configuration with respect to the main diagonal 21 and is divided into different areas of three different categories:

1. a first zone 22 of "no additional overdrive" with a weighting factor W of zero (W=0) around the main diagonal,
2. a second 23 zone of a partial overdrive with a weighting factor W between zero and one (0<W<1), with a first part 24 abutting on an upper side of the first zone 22 and a second part 25 abutting on a lower side of the first zone 22 and
3. A third 26 zone of full overdrive with a weighting factor W equal 1 (W=1) with one part 27 abutting on an upper side of the first part 24 of the second zone 23 and another part 28 abutting on a lower side of the second part 25 of the second zone 23.

Figure 3B:
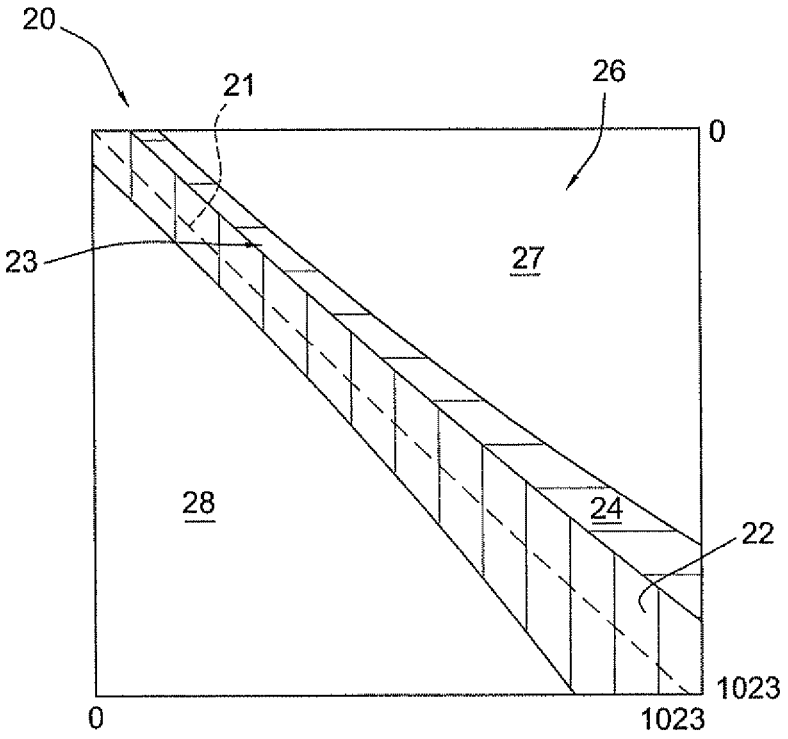
Figure 3C:
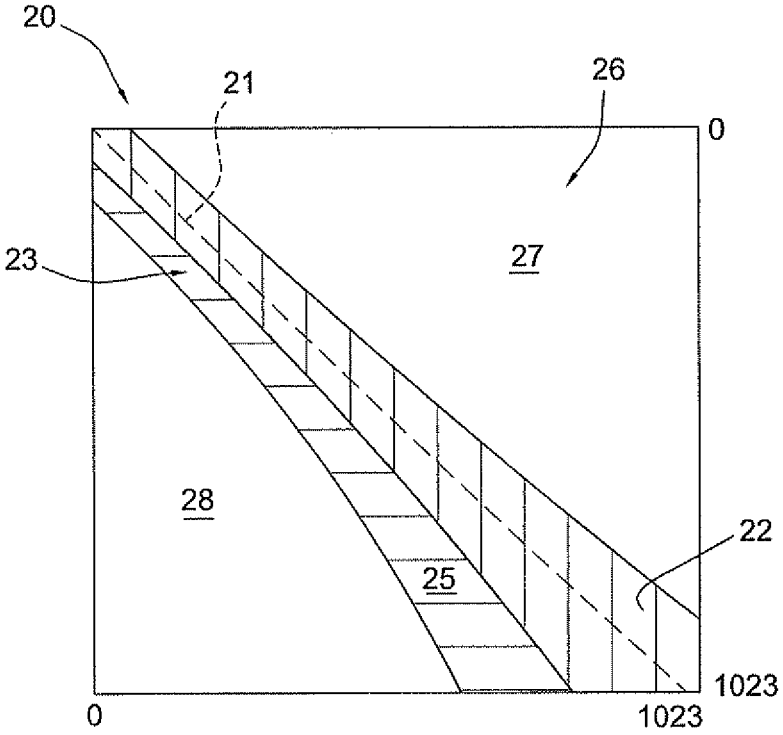
Figure 3D:
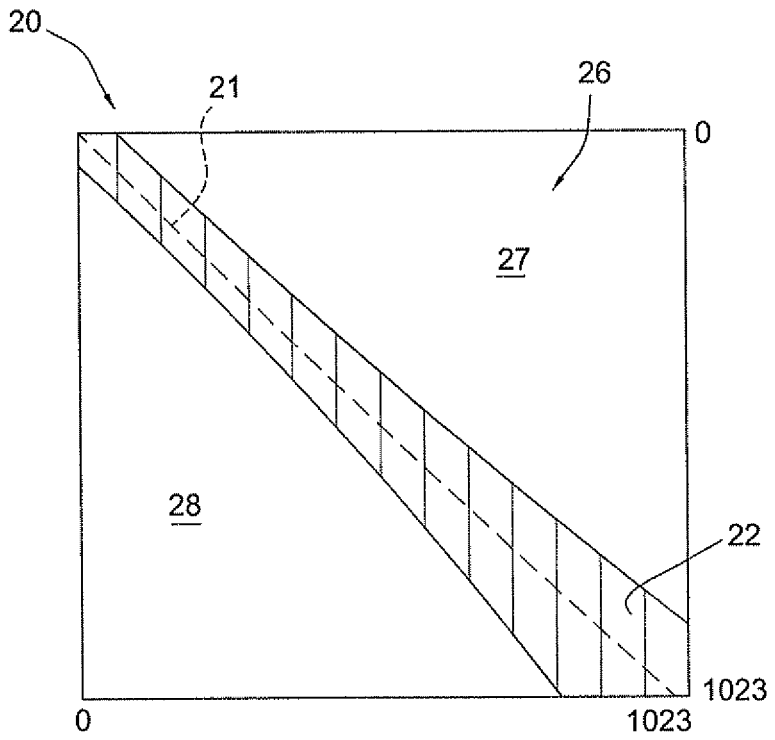
Figure 3E:
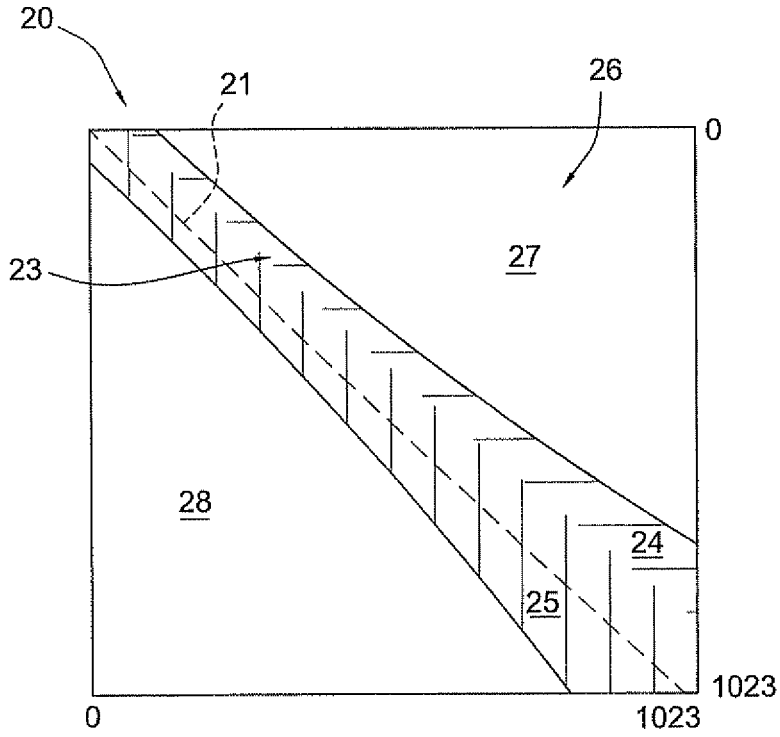

The shape of each of the different zones 22, 23, 26 (and respectively the border between the zones) is based on the brightness sensitivity of the human visual perception system ("the human eye"). In some practical implementations zone 22 and/or zone 24 and/or zone 25 may be absent. FIGS. 3*b*, 3*c* and 3*d* represent the cases where zone 24, 25 and 24 and 25 are respectively absent. FIG. 3*e* represents a case where zone 22 is absent, i.e. the overdrive applied will always be greater than 0. (In other words, in practice, the zones 22-24 could be merged as well as 25 and 23).

Figure 4:
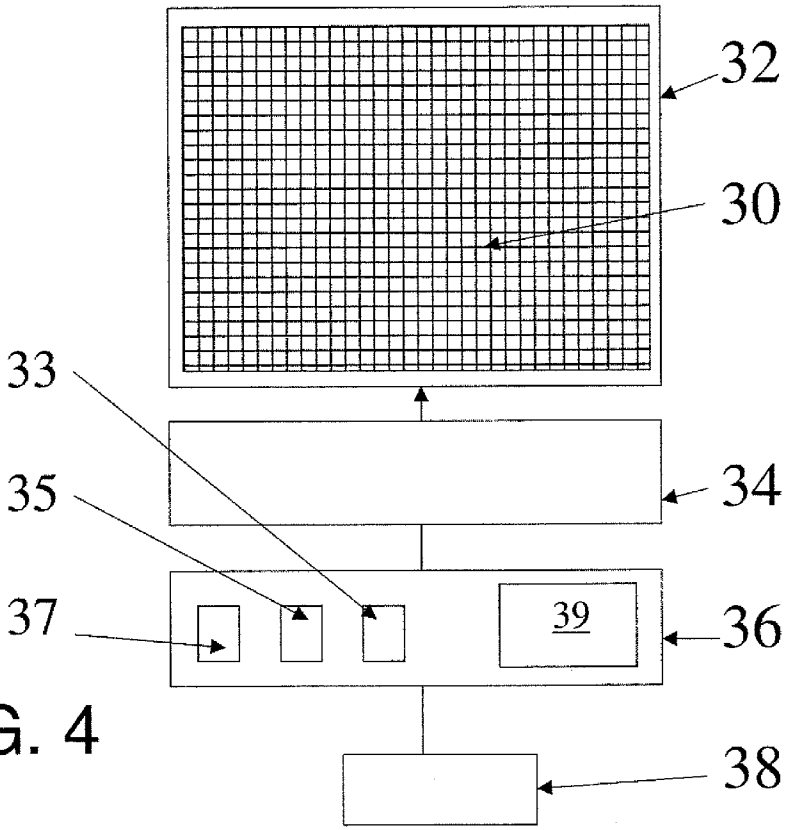
FIG. 4 shows a display device having means for providing an overdrive magnitude and a pixel intensity value during a frame-changeover in accordance with an embodiment of the invention.

FIG. 4 is a schematic representation of a display system according to an embodiment of the present invention including a signal source 38, a controller unit 36, a driver 34 and a display 32 with a matrix of pixel elements 30 that are driven by the driver 34. The display is for example a liquid crystal display, e.g. a transmissive display such as an LCD or a reflective display such as an LCOS display.

To display a certain grayscale, a liquid crystal display is characterized by means of its electro-optical transfer function which is typically S-shaped. This S-curve can be obtained by measurement and/or simulations and only takes into account a single pixel. Unwanted grayscale variations in the display visible on uniformly expected gray patterns can be additionally compensated by a uniformity correction on top of this transfer function.

The methods and systems described can also be applied to color displays. A first easy way of doing this is by just replicating the described algorithms for every color channel of the display. Eg. if a display system has three primary colors (for example: red, green and blue), then one could apply the device and method for reducing artefacts for every color channel independently. Although for some display systems this may result into a satisfactory solution, there are some problems with this approach.

One problem is that independently applying the disclosed methods and devices to the color channels will typically result into color artefacts. This is explained by means of an example for a color display having three primary colors: red, green and blue. Suppose that in such a display system, a pixel is driven to values (R1, G1, B1) for the three primary colors, and in a next frame this pixel will be driven at values (R2, G2, B2). Driving values (R1, G1, B1) correspond to a particular color point. This means that pixel (R1, G1, B1) will be perceived by a (human) observer to have a specific color. This color can be expressed by means of one of the many existing standardized color spaces such as but not limited to the Lab space, the Yxy space, . . . Pixel (R2, G2, B2) can have not only a difference luminance value, but also a different color point than pixel (R1, G1, B1). If the methods disclosed in this patent would be applied independently then the individual sub pixels (corresponding to red, green and blue primary colors) will be overdriven by the algorithm such that each of the sub pixels independently will reach the target value as soon as possible (optionally also assuming that the requested transition is above a threshold as explained earlier in the text). In such a situation, it is possible that eg. the transition of the red sub pixel (going from value R1 to R2, for example value 30 to 180) is much faster than the transition of the green sub pixel (going from value G1 to G2, for example going from value 80 to 90) and also much faster than the transition of the blue sub pixel (going from value B1 to B2, for example going from value 91 to 100). If this is the case, then independently applying the method to the individual sub pixels will have as a result that the red sub pixel will reach its target (much) quicker than the green sub pixel and the blue sub pixel, and therefore the resulting color point of the pixel (after one frame) will be too red. If this pixel remains stable at value (R2, G2, B2) for some time then the color point of the pixel will become correct as soon as each of the sub pixels reached its intended target value. However, if the pixel value changes dynamically, then it is possible that most of the time there will be a error in the color point of the pixel. For some color critical applications (such as eg. endoscopy) this error in the color point is not acceptable.

Therefore a solution to this problem has been developed and is disclosed in this patent application. A first possibility is to dynamically adapt the level of overdrive of each of the sub pixels, such that each of the sub pixels equally fast reach their target. For example: suppose there are three sub pixels (red, green and blue) and by means of maximum overdriving, the red sub pixel can reach 90% of its target value after one frame; the green sub pixel can reach 60% of its target value after one frame; and the blue sub pixel can reach 80% of its target value after one frame. Then according to the present invention, the red and the blue sub pixel will not be overdriven at maximum potential. Instead, the level of overdrive for the red and the blue sub pixel will be reduced such that after one frame they reach the same percentage of their target value as the slowest (in this case green) sub pixel. This means that after one frame, the red subpixel, the blue sub pixel and the green sub pixel will all have reached 60% of their target value. Because all sub pixels now perform their transition equally fast, the color point of the entire pixel, after one frame, will be correct. Note that in some situations, a transition for one or more sub pixels may be that fast, that even without overdriving (so reducing the level of overdrive to zero) the sub pixel reaches the target in a single frame. In such a situation it is possible to adapt the driving of such fast sub pixel. Eg. suppose that the red sub pixel needs to change from level 20 to 40 and should be slowed down to reach 50% of its target value after one frame (because eg. the green sub pixel with maximum overdrive reaches only 50% of its intended target after one frame), but the red sub pixel even without overdrive reaches 75% (level 45) of its intended target value. In such situation one could e.g. reduce the step applied to the red sub pixel to e.g. level 35 such that the value effectively reached after one frame will be level 30 (and corresponding to 50% of the originally requested step of level 20 to level 40). This is equivalent to having negative values for overdriving.

Reducing the level of overdrive of sub pixels, to make sure that the color point of a pixel is correct, obviously can result into larger intensity/luminance errors compared to the situation where all sub pixels are overdriven independently. Therefore, the current invention also has the possibility to come to a compromise solution between luminance/intensity accuracy and accuracy of the color point. This is possible by making the level of reduction of overdriving of sub pixels dependent on an error criterium that takes into account both the remaining luminance error and the remaining color error. This error criterium could eg. be the sum of the remaining luminance error after one frame and the remaining color error after one frame. Of course more complex non linear error criteria/functions are possible. By minimizing the error criterium a balanced solution can be obtained.

The current invention can also be applied for color sequential display systems. In color sequential display systems, there are no colored sub pixels, but the colors are obtained by sequentially generating color fields. A single pixel then can generate a desired color by sequentially modulating the amount of eg. red, green and blue (systems with more, less and other primary colors are also possible) that is desired. In the case of a 3 color system, a single pixel could eg. show three fields (a red, green and blue field) and therefore make three transitions from a particular level to another level, per image frame. In such systems, transitions and response time of a single pixel will also influence the color point of that pixel. In the same way as explained earlier in this text, it is possible to define an error criterium that represents a weighted average of the remaining color point error and the remaining luminance error. The level of overdrive of the transitions of a single pixel can then be determined in such a way that the error criterium is minimized.

The level of overdrive can be further adapted based on specific requirements such as but not limited to the fact that the rise and the fall time of pixel transitions should be equal. Having equal rise and fall time for pixel transitions is recommended to avoid visual flicker of the display.

The present invention also provides a controller 36 (FIG. 4) for controlling the driver 34 that determines the operation of each pixel 30 of the liquid crystal display for displaying a predetermined image. The controller 36 includes a calculator 39 which is adapted for calculating an overdrive signal for each pixel 30. Any of the functionality of the controller 6 may be implemented as hardware, computer software, or combinations of both.

The calculator 39 may be implemented with a general purpose processor, an embedded processor, a digital signal processor (DSP), an application specific integrated circuit (ASIC), a field programmable gate array (FPGA) or other programmable logic device, discrete gate or transistor logic, discrete hardware components, or any combination designed to perform the functions described herein. A general purpose processor may be a microprocessor, controller, microcontroller or state machine. A processor may also be implemented as a combination of computing devices, e.g., a combination of a DSP and a microprocessor, a plurality of microprocessors, one or more microprocessors in conjunction with a DSP core, or any other such configuration. The controller 36 is for controlling the display device such that artefacts are reduced by overdriving at least one control signal for controlling the pixel intensity of each pixel during frame-changeover, wherein the overdrive is carried out in dependence of the magnitude of an intensity step between the designated start intensity value S of the pixel within the current frame and the designated target intensity value T of the pixel within the or a following frame.

The controller 36, e.g. calculator 39, determines the overdrive magnitude during frame-changeover for each individual pixel in accordance with embodiments of the invention as described above. Starting points for the controller 36, e.g. calculator 39, are predetermined values S, T, CL stored in three frame memories 33, 35, 37 to which the controller 36 has access. The first frame memory 33 stores a set of start intensity values S of the pixels within the current frame, the second frame memory 35 stores the target intensity values T of the pixels within a or the following frame that follows the current frame, and the third memory 37 stores the currently reached intensity levels CL of the pixels within the current frame.

The controller 36, e.g. calculator 39, is adapted to determine an overdrive value OV of the control signal from the currently reached intensity level CL from the third memory 37 and the target intensity value T from the second memory 35. The controller 36, e.g. calculator 39, gives as an output the overdrive value OV that needs to be added to the data sent to the corresponding pixels of the display device. The driver applies the signal to the pixel based on instructions given by controller 36 and calculator 39.

The controller 36, e.g. calculator 39, then determines a relative overdrive value ROV of the control signal from the start intensity value S from the first memory 33 and the target intensity value T from the second memory 35. The controller 36, e.g. calculator 39, then gives as an output the relative overdrive value ROV for the current frame-changeover. The driver actually applies the signal to the pixel based on instructions given by controller 36 and calculator 39.

Next the controller 36, e.g. calculator 39, determines an overdrive intensity value OIV of the control signal from the target intensity value TV, the overdrive value OV and the relative overdrive value ROV. The overdrive intensity value OIV is given as equation 1 above.

Next the controller 36, e.g. calculator 39, determines a pixel intensity value PV of the control signal from the currently reached intensity level CL from the third memory 37 and the target intensity value T from the second memory 35. The controller 36, e.g. calculator 39, then gives as an output the intensity value IV that will actually be reached after one frame-changeover. The intensity value IV may be the target intensity value T, but is not necessarily this value. The driver actually applies the signal to the pixel based on instructions given by controller 36 and calculator 39.

The controller 36, e.g. calculator 39, in this embodiment determines a degree of overdrive that needs to be determined based on the requested intensity step. Accordingly, the degree of overdrive is not determined based on the actual state of the pixel. Small intensity steps (i.e. pixel transitions) that are likely to be noise will not be (or will be relatively little) overdriven. Larger intensity steps (i.e. pixel transitions) that are likely to contain a useful signal will be fully overdriven. To determine what small and large transitions are, a characterization of the image noise is preferably performed. In accordance with separate embodiments of the present invention, this characterization can either be done online or offline. If it is done online then a step can be to determine e.g. to calculate a noise floor of the images being displayed and use this information to decide what control signals will be overdriven. Calculating the noise floor of the images being displayed can be done continuously or at regular intervals. In an alternative embodiment this can be done offline, e.g. by selecting degrees of overdriving based on the type of image or the type of detector being used. The controller 36 can then use these "presets" based on the image type or detector type being visualized at a specific moment in time.

The controller 36 may use the overdrive weighting converter, e.g. table 20 of FIG. 3. Each cell of the table 20 comprises a predetermined overdrive weighting factor W or predetermined overdrive weighting function, taking the human visual perception system (the average human eye) into account.

The controller 36 may use the different areas of three different categories of the weighting table:

4. a first zone 22 of "no additional overdrive" with a weighting factor W of zero (W=0) around the main diagonal,
5. a second 23 zone of a partial overdrive with a weighting factor W between zero and one (0<W<1), with a first part 24 abutting on an upper side of the first zone 22 and a second part 25 abutting on a lower side of the first zone 22 and
6. A third 26 zone of full overdrive with a weighting factor W equal 1 (W=1) with one part 27 abutting on an upper side of the first part 24 of the second zone 23 and another part 28 abutting on a lower side of the second part 25 of the second zone 23.

The shape of each of the different zones 22, 23, 26 (and respectively the border between the zones) is based on the brightness sensitivity of the human visual perception system ("the human eye").

Figure 5:
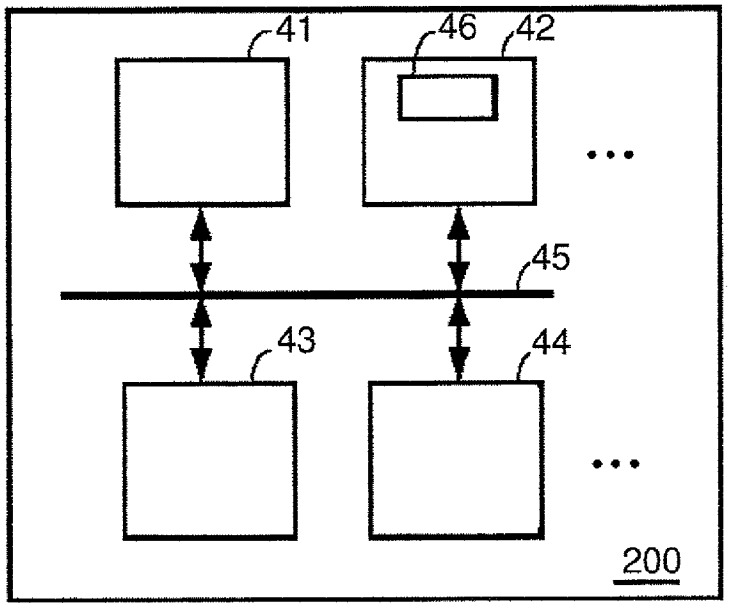
FIG. 5 shows a processing engine for use with a display device having means for providing an overdrive magnitude and a pixel intensity value during a frame-changeover in accordance with an embodiment of the invention.

An optical measurement system can be used to record the different pixel intensity transitions. A physical model is used to fit the raw point measurements (H. Wang et al. "Correlations between liquid crystal director reorientation and optical response time of a homeotropic cell", (J. of Applied Physics, 2004)). The pixel intensity value is converted to the intensity emitted by the display in cd/m$^2$ due to the non-linearity behavior of LCD panel (s-curve native, Intensity-Luminance value in function of digital driving level). The methods described above according to embodiments of the present invention may be implemented in a processing system 200 such as shown in FIG. 5 schematically. FIG. 5 shows one configuration of processing system 200 that includes at least one customisable or programmable processor 41 coupled to a memory subsystem 42 that includes at least one form of memory, e.g., RAM, ROM, and so forth. It is to be noted that the processor 41 or processors may be a general purpose, or a special purpose processor, and may be for inclusion in a device, e.g., a chip that has other components that perform other functions. Thus, one or more aspects of the method according to embodiments of the present invention can be implemented in digital electronic circuitry, or in computer hardware, firmware, software, or in combinations of them. The processing system may include a storage subsystem 43 that has at least one disk drive and/or CD-ROM drive and/or DVD drive. In some implementations a user interface subsystem 44 may be provided for a user to manually input information or adjust the operation. More elements such as network connections, interfaces to various devices, and so forth, may be included in some embodiments, but are not illustrated in FIG. 5. The various elements of the processing system 40 may be coupled in various ways, including via a bus subsystem 45 shown in FIG. 21 for simplicity as a single bus, but will be understood to those in the art to include a system of at least one bus. The memory of the memory subsystem 42 may at some time hold part or all (in either case shown as 46) of a set of instructions that when executed on the processing system 40 implement the steps of the method embodiments described herein.

In the pipeline of processing, the reducing artefact solution is placed after the image processing.

The present invention also includes a computer program product which provides the functionality of any of the methods according to embodiments of the present invention when executed on a computing device. Such computer program product can be tangibly embodied in a carrier medium carrying machine-readable code for execution by a programmable processor. The present invention thus relates to a carrier medium carrying a computer program product that, when executed on computing means, provides instructions for executing any of the methods as described above. The term "carrier medium" refers to any medium that participates in providing instructions to a processor for execution. Such a medium may take many forms, including but not limited to, non-volatile media, and transmission media. Non-volatile media includes, for example, optical or magnetic disks, such as a storage device which is part of mass storage. Common forms of computer readable media include, a CD-ROM, a DVD, a flexible disk or floppy disk, a tape, a memory chip or cartridge or any other medium from which a computer can read. Various forms of computer readable media may be involved in carrying one or more sequences of one or more instructions to a processor for execution. The computer program product can also be transmitted via a carrier wave in a network, such as a LAN, a WAN or the Internet. Transmission media can take the form of acoustic or light waves, such as those generated during radio wave and infrared data communications, Transmission media include coaxial cables, copper wire and fibre optics, including the wires that comprise a bus within a computer.

Accordingly, the present invention also includes a software product which when executed on a suitable computing device carries out any of the methods of the present invention. Suitable software can be obtained by programming in a suitable high level language such as C and compiling on a suitable compiler for the target computer processor. Target computer processor can be (for example but not limited to): the general purpose processor (CPU) in a computer system, a graphical processor (such as a GPU) of a computer system, a general purpose processor present in a display system, a graphical processor (such as a GPU) present in a display system, an embedded processor present in a display system, a processor present in a panel such as a LCD panel or oled panel or plasma panel, a processor present in the driver system of a liquid crystal display panel.

Accordingly the present invention provides a computer program product for controlling a display device having means of reducing imaging artefacts during a frame-changeover from a current frame to a following frame displayed by a display device comprising a plurality of pixels, the computer program product comprising code segments that are executable on a processing engine to provide: means for reducing the artefacts by overdriving at least one control signal for controlling the pixel intensity of the related pixel during a frame-changeover, means for reducing the artefacts being adapted to carry out the overdrive in dependence of a magnitude of an intensity step between a designated start intensity value of the pixel within the current frame and a designated target intensity value of the pixel within a or the following frame.

The code segments may further comprise, when executed on a processing engine: means for determining an image noise characteristic from a set of frames, the set comprising at least the current frame and the or a following frame, wherein the overdriving is based upon the determined image noise characteristic.

The means for reducing the artefacts preferably determines the magnitude of the overdrive based on a set of predetermined overdrive magnitudes.

The code segments, when executed on a processing engine, can be adapted to allow the means for reducing the artefacts to carry out the overdrive additionally in dependence of the magnitude of an intensity step between a currently reached intensity level of the pixel within the current frame and the target intensity value of the pixel within the or a following frame.

The code segments, when executed on a processing engine, can also allow the means for reducing the artefacts to weight the magnitude of the overdrive by a predetermined overdrive weighting factor or predetermined overdrive weighting function, taking the human visual perception system into account.

While the invention has been illustrated and described in detail in the drawings and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims.

For example it is known that temporal behavior of display systems (such as LCDs) depends on the temperature. Temperature of the panel can change e.g. because of changes in ambient temperature, changes in backlight setting, . . . . This means that in theory the overdrive converters, e.g. tables need to be adapted when the temperature of the panel changes.

This problem can be solved in three different ways.

A first possibility is to store several overdrive converters, e.g. tables that correspond to several panel temperatures. In real-time that converter, e.g. table can be selected that matches best the current panel temperature. The current panel temperature can be measured by means of a temperature sensor. To even further increase accuracy it is possible to interpolate between several overdrive converters, e.g. tables.

A second possibility is to measure (in real-time) continuously the response time behavior of the panel. When the temperature changes then the response time behavior of the panel will change and this will be detected. Based on the new measurements a new adapted overdrive converter, e.g. table then can be calculated that corresponds to the current panel temperature.

A third possibility is to stabilize the panel temperature. By means of an active cooling/heating system that can include eg. fans, it is possible to stabilize the panel temperature to a predetermined temperature range, and this independently of eg. the ambient temperature or the backlight setting. If the temperature stabilization is working well, then there is only need for one overdrive table that corresponds to the temperature range to which the panel is stabilized. In extreme situations it may not be possible to always stabilize the panel temperature to one predetermined temperature range. In that case one can define several such predetermined temperature ranges and make sure that the panel temperature is always within one of them. E.g. one could have two panel temperature ranges: 30° C.-32° C. and 40° C.-42° C. Depending on the ambient temperature (being low or high) the panel temperature can be stabilized to the range 30° C.-32° C. (in case of low ambient temperature) or the range 40° C.-42° C. (in case of higher ambient temperature). For each of these two temperature ranges we can store a predefined overdrive table in the display system. Depending on to which temperature range the panel is stabilized, the appropriate overdrive table is selected in real-time. In this way it is possible to ensure correct overdrive behavior even if e.g. the ambient temperature or the backlight settings change.

Or for example, as an improvement of the solution described for temporal response improvement, JND (Just Noticeable Differences) representation could be used as well to compute the overdriving values instead of the luminance values in cd/m$^2$. The JND for static images were computed and described by NEMA-DICOM [NEMA. *Digital imaging and communications in medicine* (*DICOM*), *part* 14*: Gray-scale Standard Display F unction*, volume PS 3.14. National Electrical Manufacturers Association, 2001]. By using the static contrast sensitivity of the human visual system Barten's model [P.G.J. Barten. Physical model for the contrast sensitivity of the human eye. In *SPIE*, volume 1666, pages 57-72, 1992.], JND can be computed from luminance values, the JND must be recomputed for dynamic images by taken into account the temporal constrast sensitivity function of the human visual system described by Barten [P.G.J. Barten. Spatio-temporal model for the contrast sensitivity of the human eye and its temporal aspects. In *SPIE*, volume 1913, pages 2-14, 1993.] and the frequency of the display.

In the claims, the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A method for controlling imaging artefacts during a frame-changeover from a current frame to a following frame displayed by a display device comprising a plurality of pixels, said method comprising the step:

reducing the artefacts by overdriving at least one control signal for controlling the pixel intensity of the related pixel during a frame-changeover, wherein overdriving comprises the steps of:

determining a relative overdrive value for the current frame in dependence of a magnitude of an intensity step between a designated start intensity value of the pixel within the current frame and a designated target intensity value of the pixel within a following frame, wherein the magnitude of the overdrive is based on a set of predetermined overdrive magnitudes, said predetermined overdrive magnitudes being stored in a first memory, weighting the magnitude of the overdrive by a predetermined overdrive weighting factor or predetermined overdrive weighting function, said predetermined weighting factor or predetermined overdrive weighting function being based on a human visual perception system, wherein the predetermined overdrive weighting factor or overdrive weighting function is stored in a second memory, determining an overdrive value in dependence of a magnitude of an intensity step between a currently reached intensity value of the pixel within the current frame and the designated target intensity value of the pixel within the following frame, and determining an overdrive intensity value of the control signal in dependence of the predetermined target intensity value, the overdrive value, and the relative overdrive value, wherein the overdrive for the following frame is carried out in dependence of a prediction of the actual pixel intensity value reached at the beginning of the following frame.

2. The method according to claim 1, wherein the method comprises the further step of determining an image noise characteristic from a set of frames, the set comprising at least the current frame and a following frame, wherein the overdriving is based upon the determined image noise characteristic.

3. The method according to claim 1, wherein the magnitude of the overdrive is based on the type of image content being displayed or the application for which the display system is being used.

4. The method according to claim 1, wherein the magnitude of the overdrive is adapted by a predetermined overdrive weighting factor or predetermined overdrive weighting function, such that the color consistency of the display system is improved.

5. The method according to claim 1, wherein the magnitude of the overdrive for at least one type or color of sub pixel is adjusted in accordance with a transition speed of at least one other type or color of sub pixel.

6. The method according to claim 1, wherein the display device is a liquid crystal display device.

7. The method according to claim 1, wherein the artefacts are reduced by overdriving each individual control signal for controlling the intensity of each related pixel during the frame-changeover.

8. The method according to claim 1, further comprising the step of selecting the degree of overdrive, wherein during small intensity steps of the pixel, the pixel is not overdriven, and wherein during large intensity steps of the pixel, the pixel will be fully overdriven.

9. The method according to claim 1, wherein the overdriving occurs if and only if a given condition on the intensity step is met.

10. A display device having means of reducing imaging artefacts during a frame-changeover from a current frame to a following frame displayed by a display device comprising a plurality of pixels, the display device comprising:

a controller configured to reduce the artefacts by overdriving at least one control signal for controlling the pixel intensity of the related pixel during a frame-changeover, and the controller is configured to determine a relative overdrive value for the current frame in dependence of a magnitude of an intensity step between a designated start intensity value of the pixel within the current frame and a designated target intensity value of the pixel within a following frame, wherein the controller is configured to determine the magnitude of the overdrive based on a set of predetermined overdrive magnitudes, wherein the magnitude of the overdrive is weighted by a predetermined overdrive weighting factor or predetermined overdrive weighting function, said predetermined weighting factor or predetermined overdrive weighting function being based on a human visual perception system, wherein the controller is also configured to determine an overdrive value in dependence of a magnitude of an intensity step between a currently reached intensity value of the pixel within the current frame and the designated target intensity value of the pixel within the following frame and to determine an overdrive intensity value of the control signal in dependence of the predetermined target intensity value, the overdrive value, and the relative overdrive value, wherein the controller further comprises a first memory to store the set of predetermined overdrive magnitudes and a second memory to store the predetermined overdrive weighting factor or overdrive weighting function, wherein the overdrive for the following frame is carried out in dependence of a prediction of the actual pixel intensity value reached at the beginning of the following frame.

11. The display device according to claim 10, further comprising a calculator configured to determine an image noise characteristic from a set of frames, the set comprising at least the current frame and a following frame, wherein the overdriving is based upon the determined image noise characteristic.

12. The display device according to claim 10, wherein the display device is a liquid crystal display device.

13. The display device according to claim 10, wherein the artefacts are reduced by overdriving each individual control signal for controlling the intensity of each related pixel during the frame-changeover.

14. A controller for a display device that reduces imaging artefacts during a frame-changeover from a current frame to a following frame displayed by a display device comprising a plurality of pixels, the controller being configured to:

reduce the artefacts by overdriving at least one control signal for controlling the pixel intensity of the related pixel during a frame-changeover, and determine a relative overdrive value for the current frame in dependence of a magnitude of an intensity step between a designated start intensity value of the pixel within the current frame and a designated target intensity value of the pixel within a following frame, and to determine the magnitude of the overdrive based on a set of predetermined overdrive magnitudes, wherein the magnitude of the overdrive is weighted by a predetermined overdrive weighting factor or predetermined overdrive weighting function, said predetermined weighting factor or predetermined overdrive weighting function being based on a human visual perception system, wherein the controller is also configured to determine an overdrive value in dependence of a magnitude of an intensity step between a currently reached intensity value of the pixel within the current frame and the designated target intensity value of the pixel within the following frame and to determine an overdrive intensity value of the control signal in dependence of the predetermined target intensity value, the overdrive value, and the relative overdrive value, wherein the controller comprises a first memory to store the set of predetermined overdrive magnitudes and a second memory to store the predetermined overdrive weighting factor or overdrive weighting function, wherein the overdrive for the following frame is carried out in dependence of a prediction of the actual pixel intensity value reached at the beginning of the following frame.

15. The controller according to claim 14, further comprising a calculator configured to determine an image noise characteristic from a set of frames, the set comprising at least the current frame and a following frame, wherein the overdriving is based upon the determined image noise characteristic.

16. The controller according to claim 14, wherein the display device is a liquid crystal display device.

17. The controller according to claim 14, wherein controller is configured to reduce the artefacts by overdriving each individual control signal that controls the intensity of each related pixel during the frame-changeover.

18. A non-transitory machine readable medium storing a computer program product for controlling a display device having means of reducing imaging artefacts during a frame-changeover from a current frame to a following frame displayed by a display device comprising a plurality of pixels, the computer program product comprising code segments which when executed by a processing engine is configured to:

reduce the artefacts by overdriving at least one control signal for controlling the pixel intensity of the related pixel during a frame-changeover, and determine a relative overdrive value for the current frame in dependence of a magnitude of an intensity step between a designated start intensity value of the pixel within the current frame and a designated target intensity value of the pixel within a following frame, and to determine the magnitude of the overdrive based on a set of predetermined overdrive magnitudes, wherein the magnitude of the overdrive is weighted by a predetermined overdrive weighting factor or predetermined overdrive weighting function, said predetermined weighting factor or predetermined overdrive weighting function being based on a human visual perception system, wherein the controller is also configured to determine an overdrive value in dependence of a magnitude of an intensity step between a currently reached intensity value of the pixel within the current frame and the designated target intensity value of the pixel within the following frame and to determine an overdrive intensity value of the control signal in dependence of the predetermined target intensity value, the overdrive value, and the relative overdrive value, wherein the predetermined overdrive magnitudes are stored in a first memory and the predetermined overdrive weighting factor or overdrive weighting function is stored in a second memory, and wherein the overdrive for the following frame is carried out in dependence of a prediction of the actual pixel intensity value reached at the beginning of the following frame.

19. The non-transitory machine readable medium according to claim 18, wherein the computer program product comprising the code segments further comprise, when executed on a processing engine: determine an image noise characteristic from a set of frames, the set comprising at least the current frame and a following frame, wherein the overdriving is based upon the determined image noise characteristic.

* * * * *